US010815747B2

(12) United States Patent
Petrowsky

(10) Patent No.: US 10,815,747 B2
(45) Date of Patent: Oct. 27, 2020

(54) FRANGIBLE-DISC SUBASSEMBLY WITH NOVEL SEAT, SEAL AND PRESSURE EQUALIZATION PORTS

(71) Applicant: ARMOR TOOLS INTERNATIONAL INC., Red Deer (CA)

(72) Inventor: Conrad Petrowsky, Red Deer (CA)

(73) Assignee: ARMOR TOOLS INTERNATIONAL INC., Red Deer (CA)

( * ) Notice: Subject to any disclaimer, the term of this patent is extended or adjusted under 35 U.S.C. 154(b) by 0 days.

(21) Appl. No.: 15/829,696

(22) Filed: Dec. 1, 2017

(65) Prior Publication Data

US 2018/0156007 A1 Jun. 7, 2018

Related U.S. Application Data

(60) Provisional application No. 62/429,531, filed on Dec. 2, 2016.

(51) Int. Cl.
*E21B 33/12* (2006.01)
*E21B 34/06* (2006.01)

(52) U.S. Cl.
CPC ..... *E21B 33/12* (2013.01); *E21B 34/063* (2013.01)

(58) Field of Classification Search
CPC ..... E21B 33/12; E21B 34/063
See application file for complete search history.

(56) References Cited

U.S. PATENT DOCUMENTS

| | | | | |
|---|---|---|---|---|
| 4,094,539 | A * | 6/1978 | Reimert | E02D 5/523 285/309 |
| 5,924,696 | A | 7/1999 | Frazier | |
| 2011/0017471 | A1* | 1/2011 | Frazier | E21B 33/1204 166/376 |
| 2012/0205873 | A1* | 8/2012 | Turley | E21B 33/1216 277/336 |

* cited by examiner

*Primary Examiner* — Kristyn A Hall
(74) *Attorney, Agent, or Firm* — Bennett Jones LLP

(57) ABSTRACT

A subassembly for inserting a frangible pressure disc seal in the inner conduit of a tubing string in a wellbore, particularly for a deviated wellbore, to seal the tubing string to provide pressure control while required by the operator. The subassembly provides [1] for as well as [2] shock absorption to protect the disc; also provided is a [3] centering, seat engaging ring with fluid pressure vents, which sets and seals the disc from below, while providing ports or vents which supply high pressure fluid from the conduit below the disc to the disc's outer edges, thus making it perform more reliably, and also providing [4] shock absorption to the disc; also provide are [5] ports in the inside wall from the bore of the bottom subassembly to its outer surface above threads and o-ring seals between the top and bottom subassemblies to further equalize high pressure to the entire convex surface of the disc; and [6] a series of set-screws accessible from outside the subassembly, through the upper sub's outer wall to grip in a groove in the outer wall of the lower sub in order to keep the two subs from separating after assembly.

6 Claims, 7 Drawing Sheets

FRANGIBLE-DISC SUBASSEMBLY WITH NOVEL SEAT, SEAL AND PRESSURE EQUALIZATION PORTS

FIELD OF THE INVENTION

The present invention relates generally to a subassembly for use in a completion/drilling string in directional, horizontal, deviated or vertical wells during operations such as snubbing, bridge plug retrieval or zone separation operations in combination with packers and/or completion strings; the sub provides a plug for non-vertical situations which can be opened without wireline by application of burst pressure from surface, while maintaining reliable pressure control before that time.

BACKGROUND OF THE INVENTION

In drilling, completion or service operations in a deviated well, it is sometimes important to be able to seal the tubing string mid-way its length to isolate production or other pressurized zones of the wellbore from surface.

In the past, tubing end-plugs have been used during injection of tubing into such a well, the plugs generally being a metallic or aluminum disc attached to the bottom of the tubing string prior to injection, and then the tubing bore opened by destruction of the metallic disc when the tubing string is located at bottom hole, typically by mechanical force. This has the undesirable effect of leaving metal fragments at the bottom workface of the wellbore which is difficult or expensive to remove. These devices have only been run at the bottom of a tubing string, and cannot provide for dual sealing for tripping out of the wellbore.

Another mechanism sometimes seen is the use of an Otis® nipple, consisting of multiple profiles to receive a variety of plug devices via wireline delivery downhole. These mechanisms provide for a single plug, and while unpluggable and repluggable, are constrained by the plug delivery mechanism—that is, wireline plugs may be difficult to retrieve from deep deviated or horizontal wellbores, and may be impossible to inject and refit into landing nipples within tubing with non-vertical orientations. Additionally, if such a plug fitting fails during injection, the wireline plug may become a projectile. Similarly, multi-profile landing nipples to receive a variety of plugs are manufactured under the Baker® trade name.

Frangible pressure seals such as the breakable ceramic domes disclosed in U.S. Pat. No. 5,924,696 are also known, but the subassemblies in which those domes are installed in-line the tubing string suffer from deficiencies such as egging of interior conduit within the subassembly caused by fluid pressures deforming the subassembly body or a component of the subassembly which in turn causes ill-fitting seals with the non-deformable (frangible) ceramic discs. Other problems arise when fluid pressure is unevenly applied to the disc's surface, causing unpredictable failure, chipping and other damage to the disc; the uneven pressures are caused by the configuration of the parts of the subassembly nearest the ceramic disc, blocking fluid forces from reaching portions of the disc's body.

Thus, there is a need for a device to overcome the limitations of the prior art, in particular for use in deviated or non-vertical or horizontal wellbore situations.

SUMMARY OF THE INVENTION

To mitigate some of the problems with the prior art, this system provides:

1. A circumferential groove 16 about the same width as the lo-hi pressure seal 5 is made at the outside circumference of the ledge upon which the disc bottom shoulder and lo-hi pressure seal is held within the subassembly body. The groove captures a portion of the lo-hi seal when the subassembly is tightened to seal the bottom shoulder of the disc with the subassembly body via compression of the lo-hi pressure seal, since the compressible lo-hi seal deforms outward and inward, the outward part extending into the groove. This forms a better seal between the disc bottom shoulder and the subassembly ledge, and captures the lo-hi pressure seal's outer circumference and holds it in place when high pressures are exerted onto the disc by fluid in the tubing string. Note that "lo-hi" refers to the low pressure exerted by the subassembly onto the seal, causing it to deform into place, and the high pressure exerted by the fluid onto the seal when the subassembly is in use for pressure control in the wellbore.

2. The lo-hi pressure seal 5 is made of malleable, deformable material capable of withstanding wellbore fluid conditions (temperature, pressure, chemically active, etc.), such as a Teflon™ or similar material. It is a flat circular seal with a circular inner cutout, and is roughly the same surface area as the bottom of the frangible disc 4. In addition to the characteristic deformation into the groove 16 when tightened into place, the lo-hi pressure seal provides a shock absorption effect which counteracts some linear shock forces on the tool during its use, insertion into the wellbore, or handling, thus saving the frangible disc from mechanical forces which could damage the disc and reduce or eliminate its ability to seal the tubing string's inner conduit from fluid flow (until the disc is ruptured purposefully by the operator).

3. A centering seat engaging ring 8 is provided on the side of the frangible disc 4 opposite the bottom shoulder of the disc 4*a*, which is made of a flexible, deformable material capable of withstanding wellbore conditions. The main purpose of this seat engaging ring 8 is to center the frangible disc within the subassembly during assembly of the subassembly's parts until they are tightened and the lo-hi seal is suitably set by being deformed (see paragraph 1, above). However, the centering seat engaging ring 8 is also provided within its body 8*a* with vent or pressure ports 8*e*, 8*f* which permit high pressure fluid held by the disc 4 in the subassembly's inner bore 17 to pass by the centering seat engaging ring 8 and press upon the disc 4 at its outer circumferential edge 4*b*, ensuring that the high fluid pressure regime held by the disc 4 works on the disc's entire convex surface including the portion covered by the body of the centering seat engaging ring 8 when assembled. This pressure equalization effect avoids uneven fluid pressure on different parts of the frangible disc 4, permitting the disc to hold back fluid pressure more predictably, since an effect of the disc's body's shape is to redirect fluid pressure forces within the disc's body to its edge and evenly to the disc's bottom shoulder 4*a*.

4. The centering seat engaging ring 8, similar to the lo-hi pressure seal 5, is made of malleable, deformable material capable of withstanding wellbore fluid conditions (temperature, pressure, chemically active, etc.), such as a Teflon™ or similar material. It is a shaped circular ring with a circular inner cutout, sloped inner edge to mate with the convex surface of the frangible disc 4 when assembled together, and shaped at its other surfaces to mate with the subassembly's two main components 2, 3 when assembled together. When tightened into place, the centering seat engaging ring 8 provides a shock absorption effect which counteracts some linear shock forces on the tool during its use, insertion into the wellbore, or handling, thus saving the frangible disc from mechanical forces which could damage the disc and reduce or eliminate its ability to seal the tubing string's inner conduit from fluid flow (until the disc is ruptured purposefully by the operator).

5. There is an area of the subassembly between the top and bottom sub sections within which high pressure fluid can produce egging of the outer portion of the threaded part of the two subs unless special venting and sealing is provided. In the subassembly of this invention, o-ring groove(s) 7 and o-ring seal(s) 6 are included between the two subassemblies 2, 3 to seal that joint from fluid under high pressure to prevent that egging tendency. By sealing that joint at that location, however, a region is isolated within the subassembly toward the high pressure convex side of the frangible disc 4 below the lo-hi pressure seal 5 to which the high pressure fluid cannot easily travel, which could cause uneven pressure on the frangible disc convex surface, which as noted above (at subparagraph 3) can cause the frangible disc to fracture or behave unpredictably. To mitigate this problem, a series of spaced high pressure fluid vent holes 12 are provided in the wall of the bottom sub 3 which are in fluid communication between the subassembly's inner bore 17 and the region of the subassembly near the frangible disc 4 just below the lo-hi seal 5 when the subassembly and its associated disc, seating ring and seals are assembled.

6. It is possible that the upper 2 and lower 3 subassemblies, when assembled and screwed together, in an embodiment with mated acme threaded segments 13, could be caused to rotate apart after assembly, for example by some combination of vibrational or torsional or compressive or tensional forces, which would cause the disc 4 to be loosened with respect to the lo-hi seal 5, thus losing integrity of the functional seal meant to be provided by the subassembly to the tubing string's inner conduit. This can be prevented by adding an anti-rotation groove 14 into the outer surface of the lower subassembly 3 below the acme threads 13 and disc 4 and seals 5, 8, and providing one or more threated hole and mating set screw 9 through the wall of the upper subassembly 2 which when tightened into the subassembly's outer wall will engage with the anti-rotation groove 14 and hold the upper and lower subassemblies together, and keep them from rotating or separating.

BRIEF DESCRIPTION OF THE DRAWINGS

Embodiments of the present invention will now be described, by way of example only, with reference to the attached Figure, wherein.

DETAILED DESCRIPTION

Figure 1:
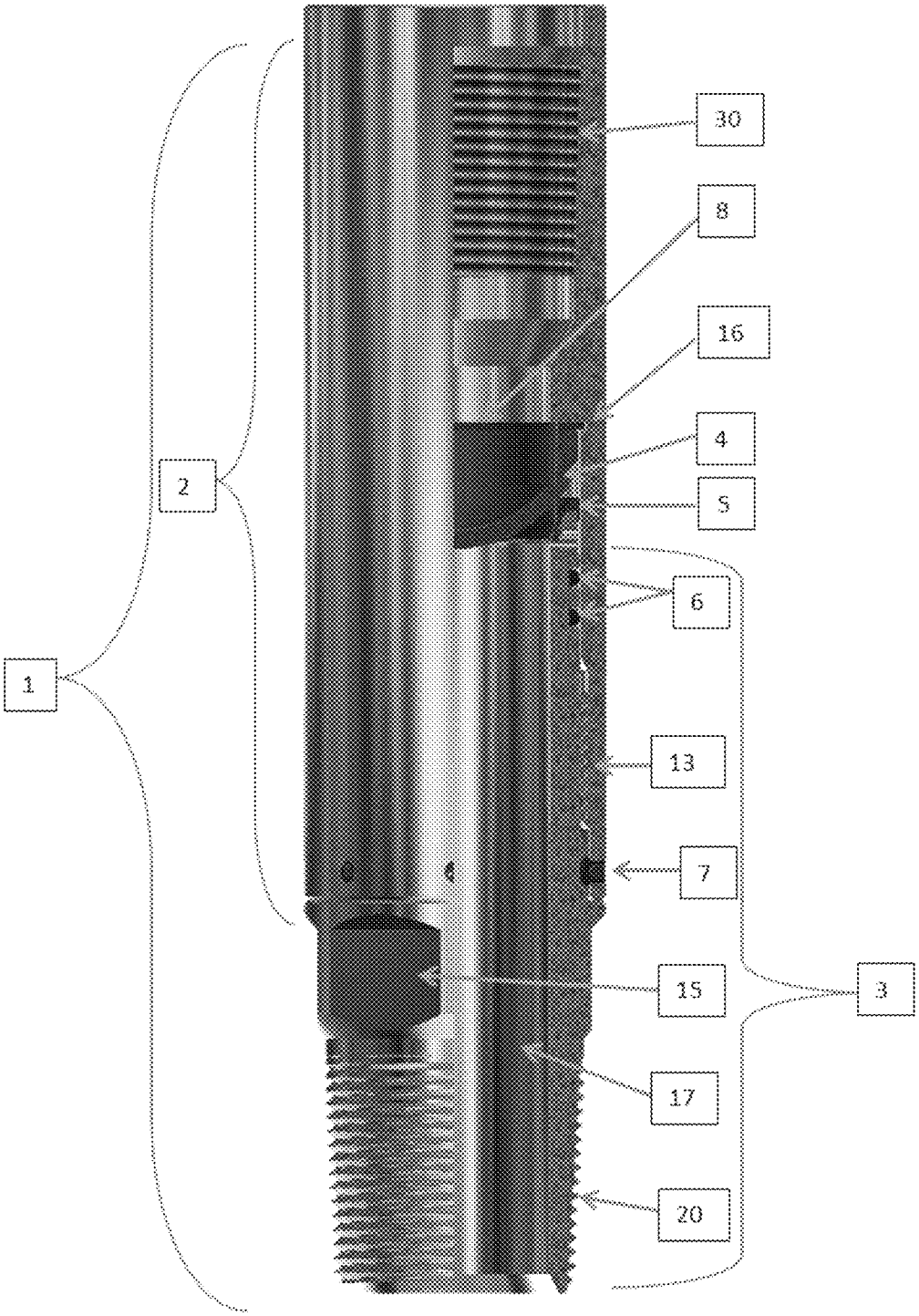
FIG. 1 is a partial cutaway of a side elevation of the subassembly and its components.
Figure 1A:
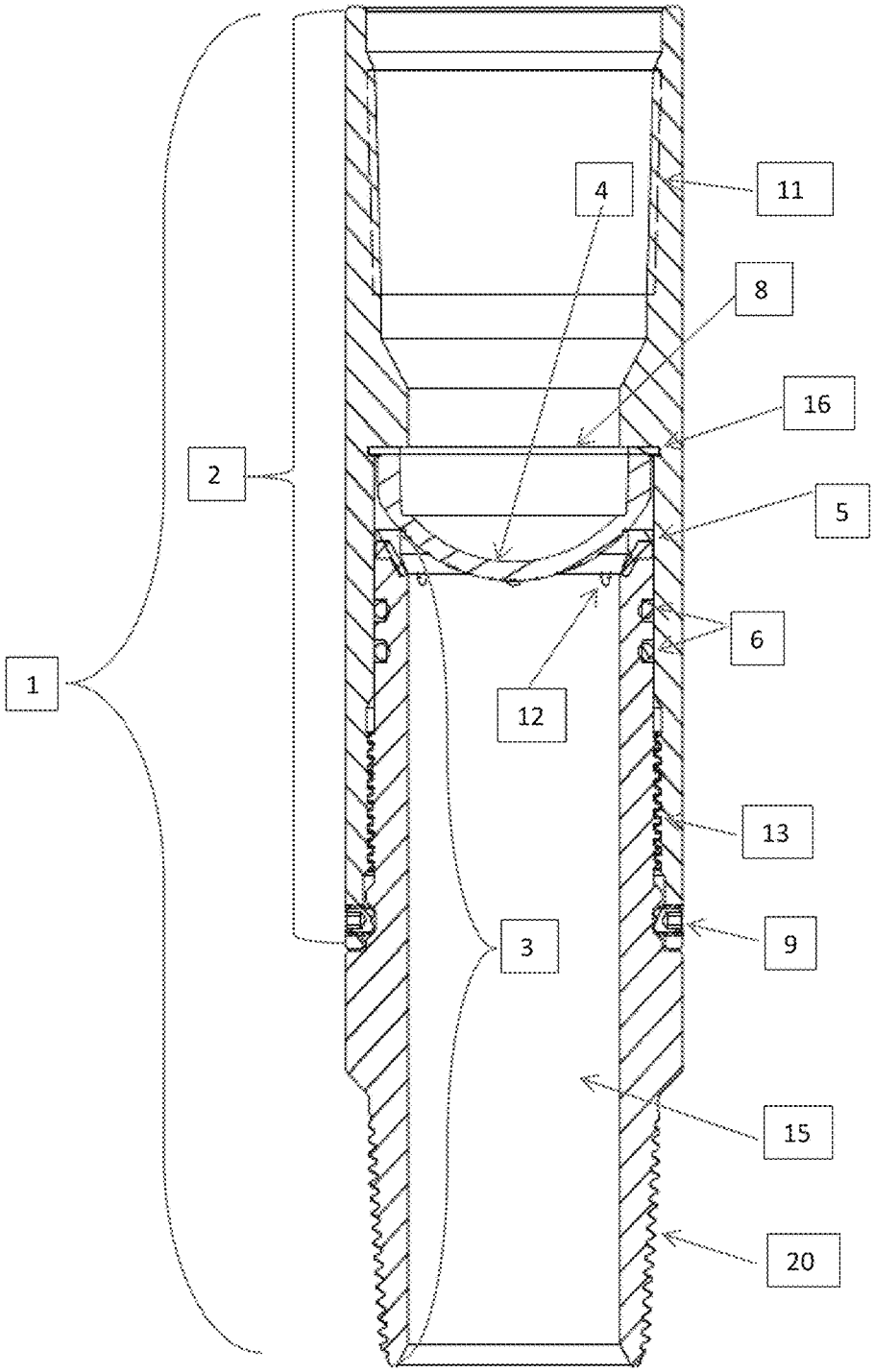
FIG. 1A is a partial cutaway of a side elevation line drawing of the subassembly and its components.
Figure 2:
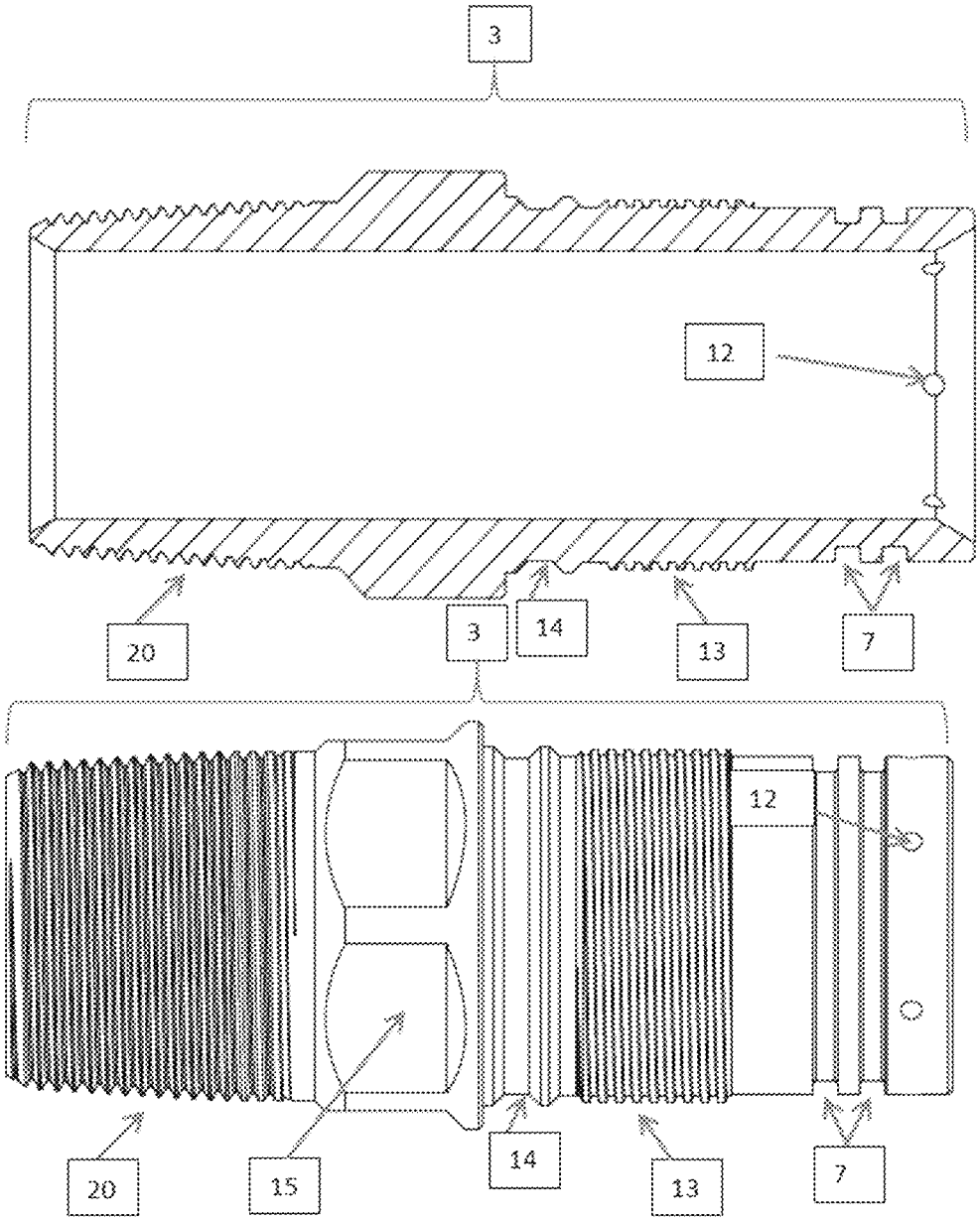
FIG. 2 shows a longitudinal cross-section of the bottom sub of the subassembly next to a side elevation of the same subassembly.
Figure 3:
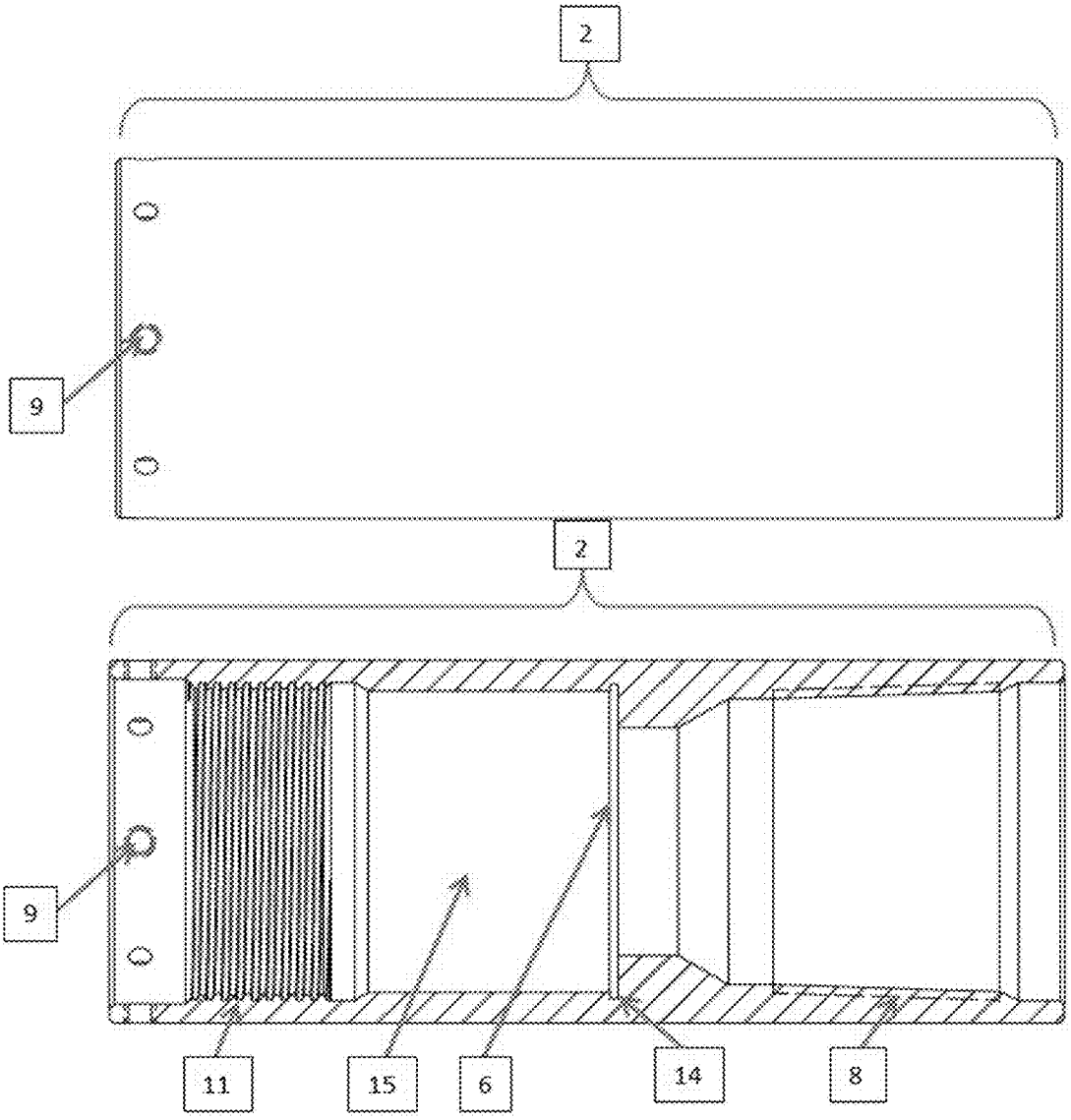
FIG. 3 shows a longitudinal cross-section of the top sub of the subassembly next to a side elevation of the same subassembly.
Figure 4:
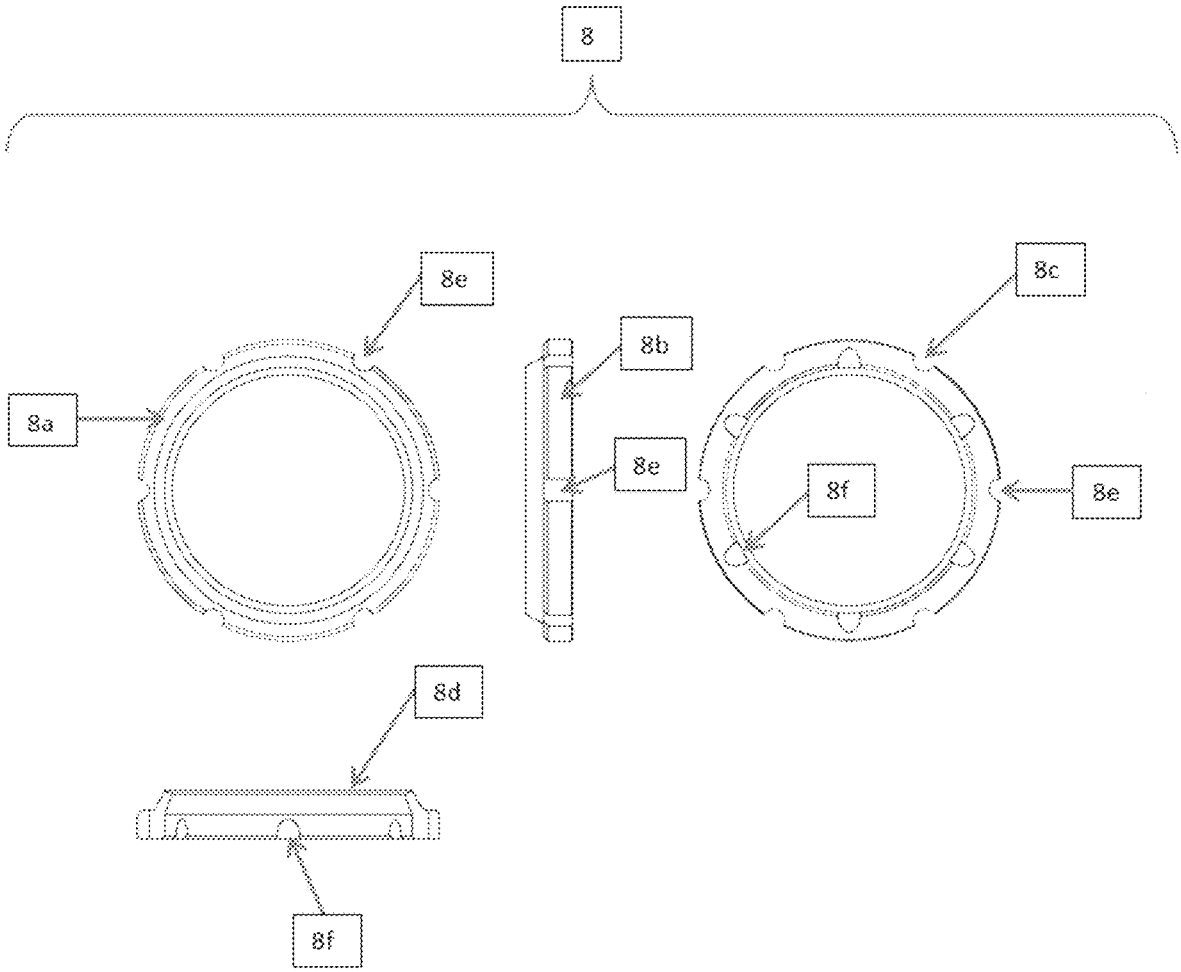
FIG. 4 shows the Centering seat engaging ring from a variety of angles.
Figure 5:
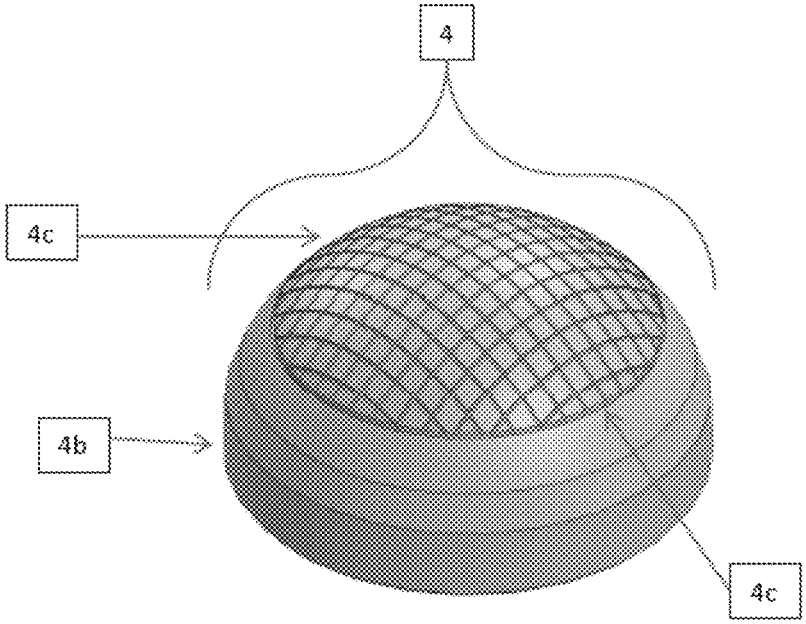
FIG. 5 shows an embodiment of a frangible disc, both at an oblique elevation rendering and a cross-sectional line drawing.
Figure 5:
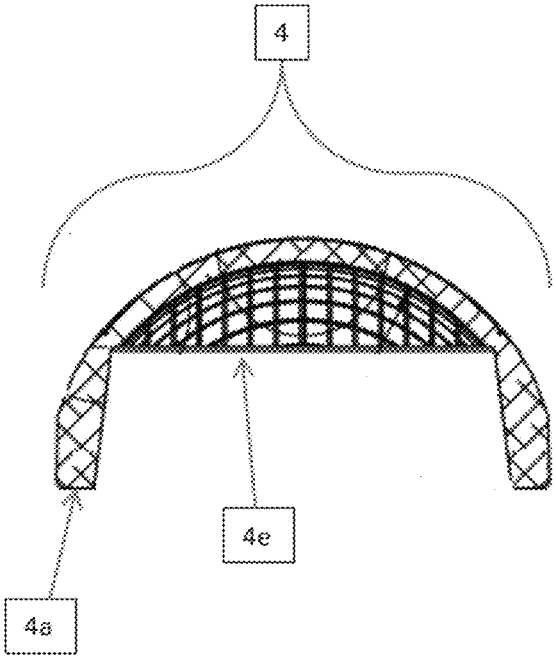
Figure 6:
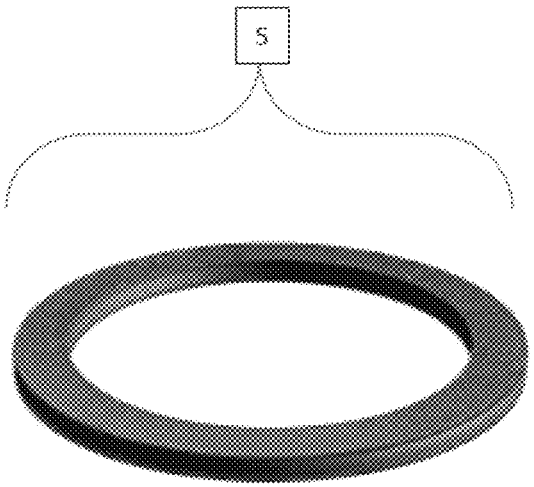
FIG. 6 shows an oblique elevation of a lo-hi pressure seal.

Generally, the present invention provides a subassembly 1 with a reliable frangible sealing disc 4 in-line in a tubing string. The frangible disc 4 when intact does not permit fluid flow from tubing attached below the subassembly through the subassembly to tubing or the wellbore above the subassembly.

The frangible disc 4, most typically made of breakable ceramic or similar substance, is designed to be breakable/broken by exertion of force from above the disc 4, such as by increasing fluid pressure within the conduit of attached wellbore tubing above the subassembly 1, while remaining unbroken/unbreakable by pressure exerted on the burst disc 4 from below the disk. Thus, the tubing string into which the subassembly 1 is assembled (not shown, above and below the subassembly 1) can be sealed by the burst disc 4 when it is intact or opened when the burst disc 4 is broken. The burst disc may be broken by exertion of increased pressure from uphole equipment, and the tubing below the subassembly can later be resealed by use of a plug in a profile plug fitting in a different subassembly (not shown) by wireline. If a plug is fitted at the plug fitting and if the burst disc 4 is unbroken, the subassembly and profile plug together provide a redundant double plug to the tubing string, enhancing reliability and safety.

This selective sealing functionality provides new and non-obvious utility to drilling, completion and other operations, in particular in situations where the lower portion of the wellbore is deviated, non-vertical, or horizontal making the use of wireline plugs impractical. The unitization of the two sealing mechanisms may provide a subassembly of short length which does not require additional assembly steps while making or breaking the tubing string.

The fluid pressure applied within the tubing string conduit into the inner passage of the subassembly and against the frangible dome's body is at high pressure, and the dome is meant to contain higher pressure on its convex surface, sealing flow from that direction in the tubing string from passing by the dome in the subassembly until the dome is broken. Due to the domed pressure load-bearing characteristics of the ceramic dome seal, the pressure forces on the convex side are conveyed through the disc body in a direction toward its outer circumference. If there are pressure variations such as lower fluid pressure at any part of the convex surface or edge of the frangible dome's body, or the dome's material structure itself is not supported at those points, this can cause uneven stresses on the dome material and unreliable disc performance, which can result in unexpected failure of the dome's material and the seal provided by the dome within the subassembly.

There are several improvements in this subassembly, namely:

1. A circumferential groove 16 about the same width as the lo-hi pressure seal 5 is made at the outside circumference of the ledge upon which the disc bottom shoulder and lo-hi pressure seal is held within the subassembly body. The groove captures a portion of the lo-hi seal when the subassembly is tightened to seal the bottom shoulder of the disc with the subassembly body via compression of the lo-hi pressure seal, since the compressible lo-hi seal deforms outward and inward, the outward part extending into the groove. This forms a better seal between the disc bottom shoulder and the subassembly ledge, and captures the lo-hi pressure seal's outer circumference and holds it in place when high pressures are exerted onto the disc by fluid in the tubing string. Note that "lo-hi" refers to the low pressure exerted by the subassembly onto the seal, causing it to deform into place, and the high pressure exerted by the fluid onto the seal when the subassembly is in use for pressure control in the wellbore.

2. The lo-hi pressure seal 5 is made of malleable, deformable material capable of withstanding wellbore fluid conditions (temperature, pressure, chemically active, etc.), such as a Teflon™ or similar material. It is a flat circular seal with a circular inner cutout, and is roughly the same surface area as the bottom shoulder of the frangible disc 4*a*. In addition to the characteristic deformation into the groove 16 when tightened into place, the lo-hi pressure seal may provide a shock absorption effect which counteracts some linear shock forces on the tool during its use, insertion into the wellbore, or handling, thus saving the frangible disc from mechanical forces which could damage the disc and reduce or eliminate its ability to seal the tubing string's inner conduit from fluid flow (until the disc is ruptured purposefully by the operator).

3. A centering seat engaging ring 8 is provided on the side of the frangible disc 4 opposite the bottom shoulder of the disc 4*a*, which is made of a flexible, deformable material capable of withstanding wellbore conditions. The main purpose of this seating seal 8 is to center the frangible disc within the subassembly during assembly of the subassembly's parts until they are tightened and the lo-hi seal is suitably set by being deformed (see paragraph 1, above). However, the centering seat engaging ring 8 is also provided within its body 8*a* with vent or pressure ports 8*e*, 8*f* which permit high pressure fluid held by the disc 4 in the subassembly's inner bore 17 to pass by the centering seating seal 8 and press upon the disc 4 at its outer circumferential edge 4*b*, ensuring that the high fluid pressure regime held by the disc 4 works on the disc's entire convex surface including the portion otherwise covered by the body of the centering seat engaging ring 8 when assembled. This pressure equalization effect avoids uneven fluid pressure on different parts of the frangible disc 4, permitting the disc to hold back fluid pressure more predictably, since an effect of the disc's body's shape is to redirect fluid pressure forces within the disc's body to its edge and evenly to the disc's bottom shoulder 4*a*.

4. The centering seat engaging ring 8, similar to the lo-hi pressure seal 5, is made of malleable, deformable material capable of withstanding wellbore fluid conditions (temperature, pressure, chemically active, etc.), such as a Teflon™ or similar material. It is a shaped circular ring with a circular inner cutout, sloped inner edge to mate with the convex surface of the frangible disc 4 when assembled together, and shaped at its other surfaces to mate with the subassembly's two main segments 2, 3 when assembled together. When tightened into place, the centering seat engaging ring 8 provides a shock absorption effect which counteracts some linear shock forces on the tool during its use, insertion into the wellbore, or handling, thus saving the frangible disc from mechanical forces which could damage the disc and reduce or eliminate its ability to seal the tubing string's inner conduit from fluid flow (until the disc is ruptured purposefully by the operator).

5. There is an area of the subassembly between the top and bottom sub sections within which high pressure fluid can produce egging, a type of deformation of the outer portion of the threaded part of the two subs away from a circular shape ("egged" or distended from an edge perspective), unless special venting and sealing is provided. In the subassembly of this invention, o-ring groove(s) 7 and o-ring seal (s) 6 are included between the two subassemblies 2, 3 to seal that joint from fluid under high pressure to prevent that egging tendency. By sealing that joint at that location, however, a region within the subassembly to the high pressure convex side of the frangible disc 4 below the lo-hi pressure seal 5 is sealed so the high pressure fluid cannot easily travel there, which avoids uneven pressure on the frangible disc convex surface, which as noted above (at subparagraph 3) can cause the frangible disc to fracture or behave unpredictably. To mitigate this problem, a series of spaced high pressure fluid vent holes 12 are provided in the wall of the bottom sub 3 which are in fluid communication between the subassembly's inner bore 17 and the region of the subassembly near the frangible disc 4 just below the lo-hi seal 5 when the subassembly and its associated disc, seating ring and seals are assembled.

6. It is possible that the upper 2 and lower 3 subassemblies, when assembled and screwed together, in an embodiment with mated acme threaded segments 13, could be caused to rotate apart after assembly, for example by some combination of vibrational or torsional or compressive or tensional forces, which would cause the disc 4 to be loosened with respect to the lo-hi seal 5, thus losing integrity of the functional seal meant to be provided by the subassembly to the tubing string's inner conduit. This can be prevented by adding an anti-rotation groove 14 into the outer surface of the lower subassembly 3 below the acme threads 13 and disc 4 and seals 5, 8, and providing one or more threaded hole 7 and mating set screw 9 through the wall of the upper subassembly 2 which when tightened into the subassembly's outer wall will engage with the anti-rotation groove 14 and hold the upper and lower subassemblies together, and keep them from rotating or separating.

In practice, the entire subassembly will be assembled upside-down at surface, with the lo-hi pressure seal inserted into its mating groove 16, the frangible disc 4 inserted with its convex side facing upward (during assembly), then the centering seat engaging ring 5 will be stacked onto the convex face of the disc 4. O-rings 6 will be placed into the grooves 7 in the lower subassembly 3, and then the lower subassembly 3 will be lowered onto the upper subassembly 2, and their mating acme threads 13 will be engaged and the subassemblies 2, 3 rotated against each other causing the threads to pull the subassemblies together. This will compress the lo-hi seal 5, deforming it to engage with the lo-hi seal groove 16, and will form a low pressure seal between the frangible disc 4 and the subassembly body 2+3, sealing the subassembly inner bore 17. The subassembly is then ready to be included into a tubing string for insertion into a wellbore. The subassembly is turned right-side-up and the subassembly's EUE pin thread 11 is matable to a conventional matching box thread in the tubing string immediately above the subassembly, and the EUE box thread 10. Once threaded into the tubing string, the subassembly and its intact frangible disc may be subjected to high fluid pressures in the tubing string below the subassembly up to the disc's convex surface inside the subassembly's inner bore 17. When the tubing string needs to be opened (that is to be put in fluid communication between both sides of the subassembly), the frangible disc 4 may be broken away by pressure applied to the concave side of the frangible disc sufficient for it to break away and open the conduit. That fluid pressure may be applied from above, for example, by surface equipment, via the tubular to the subassembly.

The subassembly can be deployed for injecting or removing tubing into a wellbore, in particular a well-bore having a vertical part from surface downward and a connected deviated or horizontal or non-vertical part below the vertical part of the wellbore. This way, the tubing can be sealed from formation pressures by the rupture disc during injection of the tubing into the well, and so the rupture disc 4 can be in place at a point in the non-vertical part of the wellbore until the bottom end of the tubing string is placed were desired by the operator, at which stage the rupture disc 4 can be broken by application of pressure down the tubing's inner conduit, thus opening the tubing's bottom end. In that setting, wire-line plugs cannot be deployed because gravity alone will not provide sufficient force to inject the plug into the tubing or the plugged tubing beyond a certain point of travel in a non-vertical direction in the bore due to frictional forces between the tubing's outside walls and the wellbore, among other forces.

A shaved or slim-hole or special combination rupture disc subassembly 1 with smaller diameter, for example 2⅞" O.D. may be used, such that two small diameter tools or strings can be worked through a 4½" liner or wellbore, while standard (non-shaved or slim-hole) 2⅞" O.D. assemblies could not.

It will be apparent to those knowledgeable about drilling, completion, workover and snubbing operations in the oil-field that the use of this invention can be applicable to other oilfield situations, and yet retains its novelty.

The above-described embodiments of the invention are intended to be examples only. Alterations, modifications and variations can be effected to the particular embodiments by those of skill in the art without departing from the scope of the invention, which is defined solely by the claims appended hereto.

LEGEND TO FIGURES

1 Rupture Disc Sub Assembly
2 Rupture Disc Top Sub
3 Rupture Disc Bottom Sub
4 Ceramic Rupture Disc
  a. Disc Bottom Shoulder
  b. Disc Vertical Shoulder
  c. Disc Out Dome
  d. Disc Inner Dome
  e. Disc Separation Groove
5 Lo-High Pressure Seal
6 Ring Seal
7 Ring Seal Groove
8 Centering Seat Engaging Ring
  a. Centering Seat Engaging Ring top view
  b. Vertical outer ring View
  c. Centering Seat Engaging Ring bottom view
  d. Horizontal inner ring view
  e. Outer pressure fluid port
  f. Inner pressure fluid port
9 Anti-Rotation Set Screws
12 Fluid Communication Port
13 Acme Threads
14 Anti-Rotation Retaining Groove/Shoulder
15 Wrench Flats
16 Lo-High Pressure Seal Seat/Groove
17 Inner Sub Bore
20 EUE Pin Thread
30 EUE Box Thread

What is claimed is:

1. A subassembly for inserting a dome-shaped_frangible pressure disc seal in the flow path inside a tubing string in a wellbore, comprising a shaped centering seat engaging ring with fluid pressure vents, where the ring sets and seals the disc from below, while providing vents which supply high pressure fluid from the tubing's conduit below the disc to the disc's outer edges, the centering ring fitted between an upper and a lower component of the subassembly to center the disc and press the disc into place within the assembled components forming the subassembly, with ports in the lower component's inside wall from a bore of the lower component to its outer surface above threads and o-ring seals disposed between the upper and lower components of the subassembly to equalize high pressure to a convex side of the disc over the entire surface of the side.

2. The subassembly of claim 1 for inserting a frangible pressure disc seal in the flow path inside a tubing string in a wellbore, comprising a lo-hi seal above the disc which deforms into a circumferential groove in the subassembly's inner wall, the lo-hi seal deforming into the groove when the subassembly is assembled providing additional security to the seal between the disc and the subassembly body.

3. The subassembly of claim 1 where the centering seat engaging ring provides shock absorption to the disc when assembled.

4. The subassembly of claim 1 where the disc is pressed into a lo-hi seal above the disc, compressing the lo-hi seal onto a ledge at a face adjacent the disc's concave surface on the disc's body, the seal being deformed to form a low pressure fluid seal between the disc and the subassembly.

5. The subassembly of claim 4 where the lo-hi seal acts as a shock absorber to protect the frangible disc.

6. The subassembly of claim 1 comprised of an upper and a lower component threadedly and removably attached together with the lower component threaded into the bore of the upper component, the upper component provided with a series of set-screws accessible from outside the subassembly passing through the outer wall to grip in a groove in the outer wall of the lower component in order to keep the two components from separating after assembly.

* * * * *